United States Patent [19]

Cabrera et al.

[11] Patent Number: 4,714,632

[45] Date of Patent: Dec. 22, 1987

[54] METHOD OF PRODUCING SILICON DIFFUSION COATINGS ON METAL ARTICLES

[75] Inventors: Alejandro L. Cabrera, Fogelsville; John F. Kirner; Robert A. Miller, both of Allentown; Ronald Pierantozzi, Orefield, all of Pa.

[73] Assignee: Air Products and Chemicals, Inc., Allentown, Pa.

[21] Appl. No.: 807,890

[22] Filed: Dec. 11, 1985

[51] Int. Cl.[4] ..... C23C 16/24

[52] U.S. Cl. ..... 427/255.1; 427/255.4; 427/318; 427/343

[58] Field of Search ..... 427/248.1, 255.1, 318, 427/255.4, 343, 344, 255.3

[56] References Cited

U.S. PATENT DOCUMENTS

| | | | |
|---|---|---|---|
| 2,665,997 | 1/1954 | Campbell et al. | 427/248.1 |
| 2,665,998 | 1/1954 | Campbell et al. | 427/248.1 |
| 2,840,489 | 6/1958 | Kempter et al. | 427/248.1 |
| 3,423,253 | 1/1969 | Sarver et al. | 148/110 |
| 3,902,930 | 9/1975 | Sata et al. | 427/248.1 |
| 4,555,275 | 11/1985 | Tobin | 427/248.1 |

FOREIGN PATENT DOCUMENTS

| | | | |
|---|---|---|---|
| 302305 | 12/1917 | Fed. Rep. of Germany | 427/248.1 |
| 2745812 | 4/1979 | Fed. Rep. of Germany | 427/248.1 |
| 774656 | 12/1934 | France | 427/255.4 |
| 1530337 | 10/1978 | United Kingdom | 427/255.1 |
| 2107360 | 4/1983 | United Kingdom | 427/255.1 |
| 668977 | 6/1979 | U.S.S.R. | 427/248.1 |

OTHER PUBLICATIONS

Pons, Galerie, & Caillet, Materials Chemistry and Physics 8 (1983) 153–161.

Dubois & Nuzzo, Reactivity of Intermetallic Thin Films by Surface Mediated Decomposition of Main Group Organometallic Compounds, J. Vac. Sci. Technol. A2(2) Apr.–Jun. 1984, 441–445.

Galerie & Caillet, Protection of Iron Against Corrosion by Surface Siliconization, Materials Chemistry, vol. 5, No. 2, pp. 147–164 (1980).

Rebuffat, Galerie, Caillet & Besson; La Protection du Aûvre par Siliciuration Superficielle; Materials Chemistry 7 (1982) 517–536.

Bertsch & Pretorius; Deactivation of Metal Surfaces for Capillary Columns for GC by Deposition of Silicon, Journal of HRC & CC, 493, 499 & 500, 1982.

Greenberg & Bauer, The Role of Silicon in Corrosion-Resistant High Temperature Coatings; Metallurgical and Protective Coatings; pp. 3–20, Thin Solid Films, vol. 95, 1982.

Wahl and Schmaderrer; The Use of Silicon-Enriched Layers as a Protection Against Carburization in High Temperature Gas-Cooled Reactors; Preparation and Characterization (1982), Thin Solid Films 94; 257–268.

Wahl and Furst; Preparation and Investigation of Layers Enriched in Silicon by Chemical Vapor Deposition, pp. 333–351.

Tuler and Schieber; Silicon-Containing Coatings Produced by a Chemical Vapour Deposition Method on Nickel-Based Superalloys, The Solid Films 73 (1980) 379–384.

Nicoll & Hildebrandt & Wahl; The Properties of Chemical Vapour-Deposited Silicon Base Coating for Gas Turbine Blading, Thin Solid Films 64 (1979) 321–326.

P. C. Felix, Coating Requirements for Industrial Gas Turbines, pp. 199–212.

(List continued on next page.)

*Primary Examiner*—Sadie L. Childs

*Attorney, Agent, or Firm*—James C. Simmons; William F. Marsh

[57] ABSTRACT

A silicon diffusion coating is formed in the surface of a metal article by exposing the metal article to a reducing atmosphere followed by treatment in an atmosphere of 1 ppm to 100% by volume silane, balance hydrogen or hydrogen inert gas mixture. Hydrogen with a controlled dew point is utilized as a surface preparation agent and diluent for the silane.

36 Claims, 6 Drawing Figures

OTHER PUBLICATIONS

Hildebrandt, Wahl and Nicoll; Phase Stability of High Temperature Coatings on NiCr-base Alloys, pp. 213-232.

Nicoll, Wahl & Hildebrandt; Ductile-Brittle Transition of High Temperature Coatings for Turbine Blades, pp. 233-252.

Wahl & Furst; Preparation and Investigation of Silicon-Enriched Layers on Metals, pp. 529-541.

Singheiser & Wahl; Protection of Nickel-Based Alloys Against High Temperature Carburization, pp. 286-292.

Van Zolingen et al, "Growth Conditions and Properties of Evaporated Semicrystalline Silicon Layers", Thin Solid Films, vol. 58, pp. 89-93, 1979.

Gdula et al, "Haze Elimination in Thick Polycrystalline Silicon Films", IBM Tech. Discl. Bulletin, vol. 21, No. 5, Oct. 1978.

METHOD OF PRODUCING SILICON DIFFUSION COATINGS ON METAL ARTICLES

FIELD OF THE INVENTION

The present invention pertains to the formation of diffusion coatings in metal surfaces and, in particular, to the formation of silicon diffusion coatings.

BACKGROUND OF THE PRIOR ART

In the prior art, it is known that objects which are to be exposed to reactive atmospheres at high temperatures may be rendered relatively inert, as compared to the base material, by deposition of a coating of metallic silicon or silicon oxide on the surface of the metallic article exposed to the reactive atmosphere and/or high temperature. In view of the fact that silicon dioxide has a high melting point, is unreactive toward many common atmosphere systems and has little catalytic activity, provision of such coatings is highly desirable. The fact that silicon dioxide has little catalytic activity has great value in such applications as equipment for steam cracking of hydrocarbons to produce ethylene. Secondary reactions which might result in the deposition of carbon on heat exchanger tubes are minimized with a silicon oxide coating on the exposed metallic surfaces in such reactors.

A number of processes are known and available for producing a siliconized surface on a metal, either to produce a silicon-rich or a silica coating. These methods are:

1. Molten metal or salt baths;
2. Pack cementation which transfers silicon to the metal by generating a volatile silicon compound in-situ by reaction between pack solids and a gas;
3. Slurry/sinter, by which a slurry of silicon-containing powder is applied to a metal, dried and sintered to produce a silicon coating. In this category, silica coatings are produced by deposition of silica solids such as sols or sol gel and sintering.
4. Chemical vapor deposition of silicon via a gaseous or vaporized silicon compound;
5. Chemical vapor deposition of silica via gaseous silicon and oxygen sources;
6. Thermal spray of melted, atomized silicon-containing material on a metal substrate;
7. Ion implantation of silicon;
8. Physical vapor deposition of silicon or silicon oxide.

Chemical vapor deposition of silicon is one of the most desirable processes for a number of reasons, including such factors as uniform coating of the substrate, relatively low application temperatures and the option of forming a silicon diffusion layer, minimum cleaning of parts after treatment, no high-vacuum requirement and the fact that the parts are amenable to continuous processing, ease of surface cleaning and post treatment. In particular, silane ($SiH_4$) is an attractive source of silicon because it is a gas containing only hydrogen and silicon thus avoiding problems caused by other gaseous or gasified silicon species such as the corrosion of process equipment or volatilization of the substrate by halide and other reactions that prevent formation of a diffusion coating such as carbon deposition and formation of silicon dioxide.

With processes involving the reaction at the surface of the object being coated, with a silicon halide such as $SiCl_4$, $Si_2Cl_6$, etc., and hydrogen, the overall reaction results in the formation of metallic silicon and hydrogen chloride. Silicon applied in this manner at temperatures greater than 1,000° C. (1832° F.) tends to diffuse into the substrate metal to form solid solutions and intermetallic compounds. These diffused coatings are especially desirable because there is no abrupt discontinuity in either composition or mechanical properties between the underlying substrate and the silicon at the surface. However, halogen-based processes suffer from a number of drawbacks centered around the reactivity and corrosivity of hydrogen chloride and other halogen derivatives. For example, iron chloride, which may be formed in the reaction, is volatile and loss of material and/or alteration of the composition of the substrate may be serious.

Another method of depositing metallic silicon is by the thermal decomposition of silane ($SiH_4$) to yield silicon metal and hydrogen. British Patent No. 1,530,337 and British Patent Application No. 2,107,360A describe methods of applying protective coatings to metal, metal with an oxide coating, or to graphite. Critical surfaces in nuclear reactors are protected from oxidation by coating with silicon at greater than 477° F. (250° C.) under dry, nonoxidizing conditions followed by oxidizing the coating at a similar temperature, but under conditions such that silicon oxidizes faster than the substrate. For example, the patentees point out in the '337 patent that the 9% chromium steel was first dried in argon containing 2% hydrogen by heating to approximately 842° F. (450° C.) until the water vapor concentration in the effluent was less than 50 ppm followed by an addition of silane to the gas stream wherein the chromium steel in the form of tubes was treated for 24 hours at temperatures between 909° and 980° F. (480° C. to 527° C.). When treated for 6 days with a mixture containing 100 ppm of water vapor, the tubes exhibited a rate of weight gain per unit area less than 2% that of untreated tubes when exposed to carbon dioxide at 1035° F. (556° C.) for up to 4.000 hours. These are overlay coatings in contrast to the diffusion coatings prepared using silicon halide described above. For example, in patent application '360A, the applicants point out the importance of limiting the interdiffusion of Si with compounds of the substrate. These overlay coatings require long deposition times for their preparation. It is possible to form Si diffusion coatings using $SiH_4$ but this requires higher temperatures. French workers produced diffusion coatings (solid solutions and metal silicides) utilizing silane under static conditions at elevated temperatures. [A. Abba, A. Galerie, and M. Caillet, *Materials Chemistry, Vol* 5, 147–164 (1980); H. Pons, A. Galerie, and M. Caillet, *Materials Chemistry and Physics, Vol.* 8, 153 (1983).] For iron and nickel, these temperatures were as high as 1100° C. (2012° F.). Others have produced metal silicides using silane on nickel using sputter-cleaned metal surfaces under high vacuum conditions. [L. H. Dubois and R. G. Nuzzo. *J. Vac. Sci and Technol.*, *A*2(2), 441–445 (1984).]

SUMMARY OF THE INVENTION

The present invention provides a process for producing a silicon diffusion coating on a metal surface by reaction of silane and/or silanehydrogen mixtures with the metal surface at temperatures below 1,000° C. (1832° F.) preferably 400° C. to 1,000° C. The process includes a pretreatment step under a reducing atmosphere, preferably hydrogen, which is controlled as to the quantity of oxygen atoms present in the gas to make sure that the substrate is devoid of any barrier oxide coatings. In the case of pure hydrogen contaminated by water vapor, control can be effected by control of the dew point of the hydrogen. After the pretreatment, exposure to the silane, preferably diluted in hydrogen, provides the desired silicon diffusion coating. A third but optional step includes oxidation of the diffused silicon to provide a coating layer or film of oxides of silicon on the exposed surface of the treated article. The process differs from the prior art by utilizing lower temperatures to obtain diffusion coatings and achieves high deposition rates at these lower temperatures.

DETAILED DESCRIPTION OF THE PREFERRED EMBODIMENT

Figure 1A:
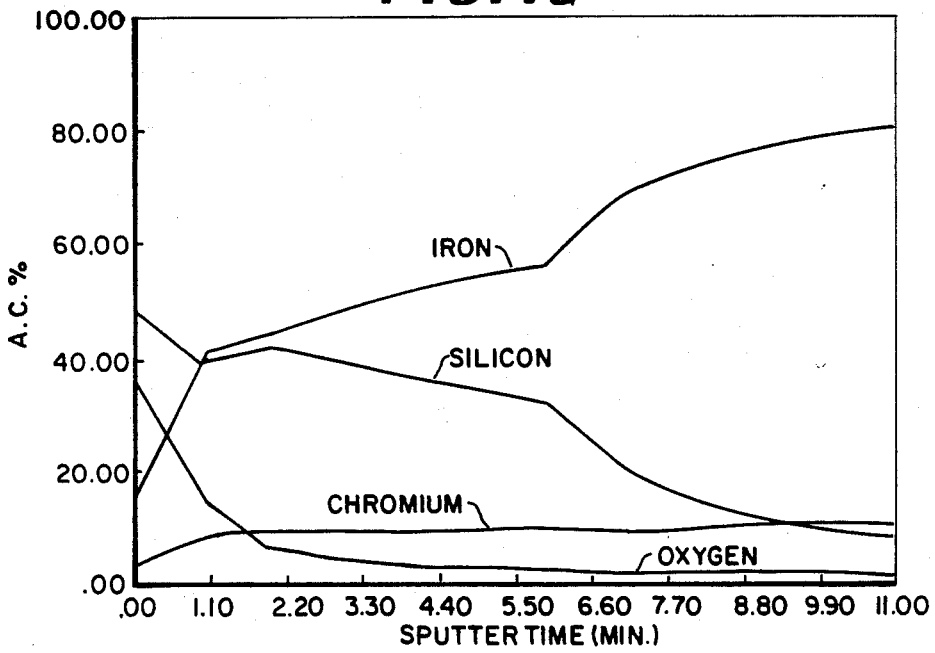
FIG. 1*a* is a plot of percent atomic concentration (A.C. %) of the critical elements determined by Auger Electron Spectroscopy (AES) against sputter time of a sample treated according to the present invention wherein the water vapor of the atmosphere was maintained at a maximum of 75 ppm during the silicon deposition step at 500° C.

The present invention is a process for siliconizing metallic surfaces by reaction of silane, either alone or diluted with hydrogen and/or hydrogen and an inert gas at temperatures below 1,200° C. (2192° F. to provide controlled silicon diffusion coatings in the metallic surface. The invention provides a process for protecting metal surfaces with the diffusion coating containing metal silicides and/or metalsilicon solid solutions as significant portions of the total coating. A diffusion coating as opposed to an overlay coating is achieved by treatment conditions under which the surface is clean; i.e., there is no surface film which might act as a diffusion barrier to prevent migration of silicon into the metal being treated or migration of the elements of the metal by habit to the surface or which might act as a passive film to prevent surface catalysis of the silane ($SiH_4$) decomposition. According to the present invention a clean surface can be achieved by maintaining conditions during pretreatment such that the atmosphere is reducing to all components of the alloy that will react with oxygen.

The present invention comprises two primary steps with an optional third step. The first step of the invention includes a pretreatment wherein the metal article to be treated is exposed at an elevated temperature (preferably 400° to 1,200° C.) under an atmosphere that is controlled to reduce or prevent formation of any oxide film which may act as a barrier coating. While numerous reducing atmospheres can be used, the preferred atmosphere is hydrogen which contains only water vapor as a contaminant at levels above 1 ppm. In this case the water vapor content (dew point) of the hydrogen is the control parameter. For example, in the treatment of low alloy steel the water vapor to hydrogen ($H_2O/H_2$) molar ratio is maintained at a level that is less than $5\times10^{-4}$.

The second step comprises exposing the pretreated article to silane, preferably in a hydrogen carrier gas or in a hydrogen-inert gas mixture under reducing conditions. In the preferred form of the invention, the silane is present in an amount from 1 ppm to 100% by volume, balance hydrogen However, it has been found that silane present in an amount of 500 ppm to about 5% by volume, balance hydrogen is very effective. Under these conditions, it has been found that if the molar oxygen content of the atmosphere is closely controlled during the treatment step, an effective diffusion coating is produced. In considering the molar oxygen content of the atmosphere all sources of oxygen (e.g. water vapor, gaseous oxygen, carbon dioxide or other oxygen donor) must be taken into account. For example, at 500° C. according to the present invention, the molar ratio of silane to oxygen (by this is meant the number of gram atoms of oxygen) ($SiH_4/O$) should be greater than 5 and the molar ratio of oxygen to hydrogen ($O/H_2$) should be less than $1\times10_{-4}$ for low alloy steel.

An optional third or post-treatment step comprises exposing the sample, treated according to the two steps set out above, to oxidation potential conditions such that oxidation of silicon is favored over oxidation of the substrate by use of a water vapor-hydrogen, hydrogen-nitrogen-water vapor or hydrogen-nitrous oxide atmosphere wherein the molar ratio of oxygen to hydrogen ratio is controlled, to produce a silicon dioxide coating, film or layer over the silicon diffusion coating.

According to the present invention, the process is applicable to all substrates which are amenable to the diffusion of silicon such as ferrous alloys, non-ferrous alloys and pure metals.

A large number of tests according to the present invention were conducted and are set out in the following examples.

EXAMPLE 1

Samples of pure iron with approximate dimensions of $0.3\times0.4\times0.004''$ were mounted on the manipulator of a deposition/surface analysis system. Samples were spot-welded to two tungsten wires and heated by a high current AC power supply. The temperature of the sample was monitored by a chromel-alumel thermocouple which was spot-welded to one face of the sample.

The samples were pretreated in pure $H_2$ at a dew point $=-60°$ C. ($P_{H2O}/P_{H2}\times1\times10^{-5}$), at a flow $=1100$ standard cubic centimeters (scc)/min and heated at 800° C. for 60 min.

The $SiH_4/H_2$ treatment was performed without interrupting the $H_2$ flow. Premixed $SiH_4/H_2$ was added to the $H_2$ flow until a mixture (by volume) of 0.1% $SiH_4$ in $H_2$ was obtained. The samples were then heated at a temperature between 500°–700° C. for a time interval between 4–15 min, at a total flow $=1320$ scc/min.

After the treatments were completed. the samples were analayzed by Auger electron Spectroscopy (AES)

and the surface elemental compositions are listed in Table 1 below. All the samples are covered with a thin film of $SiO_2$ of about 70 Å which presumably was formed when the samples were exposed to oxygen contaminants prior to the surface analysis.

The samples were inspected with X-ray fluorescence (XRF) to determine the elemental bulk composition of deeper layers since the depth of penetration of this technique is about 3 μm. Elemental concentrations were calculated from XRF intensities using the respective X-ray cross sections for normalization, and they are also displayed in Table 1. The samples were also characterized by X-ray diffraction (XRD) to determine the phases present and it was found that the siliconized surface is composed of two phases, FeSi and $Fe_3Si$. The predominant phase at 600° C. is $Fe_3Si$ while at 700° C. it is FeSi. The analyses are summarized in Table 1.

TABLE 1

| Siliconized Fe Samples | | | | | | | | | |
|---|---|---|---|---|---|---|---|---|---|
| | Treatment in $SiH_4/H_2$ | | Bulk Composition (3 μm) | | Surface Composition (10Å) | | Phases Present* | | |
| Sample No. | Temp °C.) | t (min) | Si % | Fe % | Si % | Fe % | α-Fe | $Fe_3Si$ | FeSi |
| 1 | — | — | 0.1 | 99.9 | | 100 | S | — | — |
| 2 | 500 | 4 | 0.2 | 99.8 | 10.6 | 89.4 | S | W | — |
| 3 | 500 | 8 | 0.5 | 99.5 | 16.6 | 78.0 | S | W | W |
| 4 | 500 | 15 | 0.3 | 99.7 | 10.1 | 80.9 | S | W | W |
| 5 | 600 | 4 | 27.0 | 73.0 | 42.1 | 48.7 | W | S | M |
| 6 | 600 | 8 | 28.9 | 71.1 | 34.4 | 54.3 | — | S | M |
| 7 | 600 | 15 | 22.6 | 77.4 | 45.1 | 47.2 | W | S | S |
| 8 | 700 | 4 | 28.1 | 71.9 | 50.8 | 40.6 | W | M | S |
| 9 | 700 | 8 | 30.0 | 70.0 | 68.4 | 22.2 | W | M | S |
| 10 | 700 | 15 | 39.9 | 60.1 | 91.0 | 0.0 | W | M | S |

*S strong diffraction pattern intensity
M moderate intensity
W weak intensity

According to Example 1, the tests demonstrate the formation of iron sillicide diffusion coatings on a pureiron substrate according to present invention.

EXAMPLE 2

Samples of AISI type 302 steel with approximate dimensions of 0.3×0.4×0.002" were prepared, mounted, and treated as in Example 1. A typical analysis by Atomic Absoprtion spectroscopy (AAS) of the as-received material yielded a nominal composition 7% Ni, 18% Cr and 73% Fe.

The sample was heated at 700° C. for 15 min. in atmosphere (by volume) of 0.1% $SiH_4/H_2$ at a total flow=1,320 scc/min. After the treatment was completed, the surface was analyzed by Auger Electron Spectroscopy (AES) without removing the sample from the system thus minimizing atmospheric contamination. The surface composition is set out in Table 2, after treatment and after mild Argon ion ($Ar^+$) sputtering which probe the depth of the coating. The surface is enriched with Nickel (Ni) after the $SiH_4/H_2$ treatment and as determined by X-ray Photoelectlron Spectroscopy (XPS) the Ni is in the form of Ni silicide.

TABLE 2

| Analysis of Siliconized 302 SS | | | | | | |
|---|---|---|---|---|---|---|
| | AES Atomic % | | | XPS Analysis | | |
| Element | After $SiH_4/H_2$ Treatment | After $Ar^+$ Sputtering = 160 A | Elements Detected | Binding Energy (eV) | References | Binding Energy (eV) |
| | | | Si* | 103.6 | $SiO_2$ | 103.4 |
| Si | 31.5 | 34.4 | Si | 99.7 | $Ni_2Si$ | 100.0 |
| C | 14.7 | — | Fe | 706.8 | Fe° | 706.8 |
| O | 30.7 | 2.3 | Cr | 574.1 | Cr° | 574.1 |
| Cr | — | 12.9 | Ni | 853.1 | $Ni_2Si$ | 853.1 |
| Fe | 10.7 | 42.5 | O | 532.7 | $SiO_2$ | 533.09 |
| Ni | 12.5 | 7.9 | C | 284.8 | contamination | 284.6 |

*Two peaks corresponding to Si are present; nevertheless, the peak identified as $SiO_2$ is weak indicating that it comes from residual oxide. The C and O signals are also very weak.

The foregoing tests demopnstrate the formation of a nickel silicide diffusion coating on an AISI type 302 stainless steel by the method of the present invention.

EXAMPLE 3

A sample of 1"×½"×0.004" AISI type 310 stainless steel foil was suspended using a quartz wire from a microbalance inside a quartz tube positioned in a tube furnace. The sample was treated in flowing dry $H_2$ (D.P.<−60° C.; $H_2O/H_2<1\times10^{-5}$) at 800° C. for 30 min., then cooled to 500° C. and treated in flowing dry 0.1% $SiH_4/H_2$ by volume (D.P.<−60° C.; $H_2O/H_2<1\times10^{-5}$) for a time (100 min.) long enough to deposit 0.5 mg Si. Surface analyses showed that the top 90A was composed primarily of $SiO_2$ and Ni silicide. The oxide was presumably formed on exposure of the sample to air during transport. XPS analysis after removal of the oxide film is set forth in Table 3. Ni silicide is present on the surface of the sample as was found in Example 2. An AES depth profile using Ar ion sputtering showed that the surface layer contained (1) 600 Å of Ni silicide, (2) 3000 Å region of a mixed Ni/Fe silicide with gradually decreasing Ni/Fe ratio, and (3) a region of about 3000 Å which is rich in Cr relative to its concentration in the bulk alloy and depleted in Fe and Ni.

TABLE 3

| Element | XPS Results Conc. rel. at. % | B.E. (eV) | Ref. B.E. | Ref. cpd |
|---|---|---|---|---|
| 1 Si (2p) | 48.5 | 99.4 | 100.0 | Si, $Ni_2Si$ |
| 2 Fe (2p) | 7.3 | 706.8 | 706.8 | Fe |
| 3 Ni (2p) | 44.1 | 853.2 | 853.1 | $Ni_2Si$ |

In summary, the results of Examples 2 and 3 show that for austentic stainless steel at 500° C. to 700° C., Ni and Fe have diffused to the surface to form a metal silicide layer, with Ni diffusion apparently being slightly faster than Fe, and have left behind a region depleted of these elements and rich in Cr.

EXAMPLE 4

Samples of 1"×¼"×1/16" coupons of alloy A182F9 (9% Cr/1% Mo/Fe) obtained from Metal Samples Co., were cleaned in an acetone sonic bath. The samples were then treated in a Cahn 2000 microbalance inside a quartz tube heated with a tube furnace. Gas flowed up the tube and exited at a sidearm. The following procedures were used for the treatment:

(1) Treat samples at 800° C. for 30 min. in flowing dry $H_2$ (D.P.$<-60°$ C., $H_2O/H_2<1\times10^{-5}$).

(2) Lower temperature to treatment temperature and switch to $H_2$ flow with desired dew point.

(3) Admit 0.5% $SiH_4/H_2$ mixture (by volume) to give a total flow of $H_2/SiH_4=1220$ cc/min. (15 min. at 600° C., 2.5 hr. at 500° C.).

(4) Turn off $SiH_4$, cool rapidly in $H_2$.

(5) Determine diffusion vs. overlay coating by AES depth profiling.

Figure 1B:
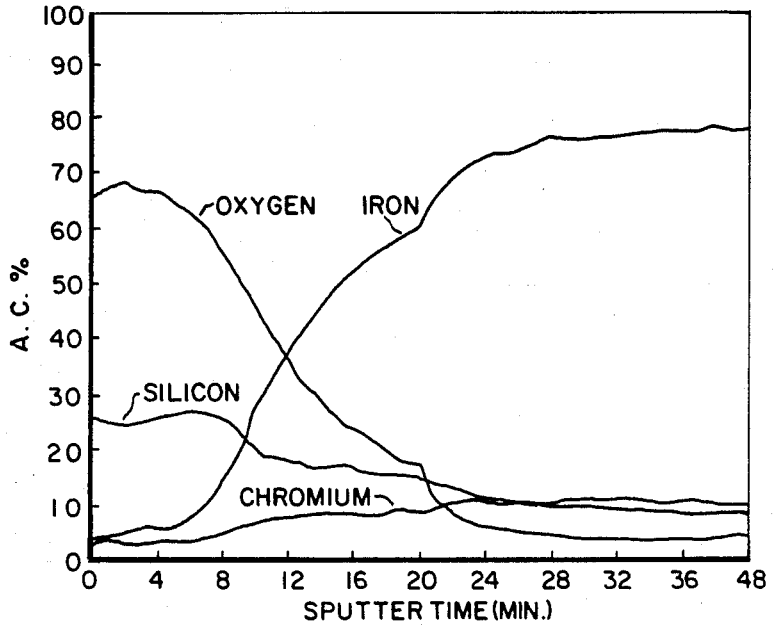
FIG. 1*b* is a plot similar to FIG. 1*a* wherein the water content was controlled to a maximum of 100 ppm during the silicon deposition step at 500° C.

Table 4 summarizes the results of the samples treated as set out above at 500° C. $H_2O$ levels of 75 ppm ($SiH_4/H_2O$)=6.7) and lower result in diffusion coatings according to the present invention whereas $H_2O$ levels of 100 ppm ($SiH_4/H_2O=5$) and higher will result in overlay coatings. FIG. 1*a* and FIG. 1*b* compare AES depth profiles for the diffusion coating at 75 ppm $H_2O$ to the overlay coating at 100 ppm $H_2O$. The sample surface in FIG. 1*a* was sputtered at a rate of 15 Å/min for six minutes and then at a rate of 150 Å/min for five minutes. The sample surface of FIG. 1*b* was sputtered at a rate of 10 Å/min for twenty minutes and then at a rate of 130 Å/min for 28 minutes.

TABLE 4

| Run Number | $H_2O$ (ppm) | $SiH_4$ (ppm) | $SiH_4/H_2O$ | Temp. (°C.) | Coating Type |
|---|---|---|---|---|---|
| 1 | 100 | 500 | 5.0 | 500 | overlay |
| 2 | 75 | 500 | 6.7 | 500 | diffusion |
| 3 | 50 | 500 | 10.0 | 500 | diffusion |
| 4 | 20 | 500 | 25.0 | 500 | diffusion |
| 5 | 10 | 500 | 50.0 | 500 | diffusion |
| 6 | <10 | 500 | >50.0 | 500 | diffusion |

Table 5 summarizes the results of the samples treated as set out above at 600° C.

TABLE 5

| Run Number | $H_2O$ (ppm) | $SiH_4$ (ppm) | $SiH_4/H_2O$ | Temp. (°C.) | Coating Type | Wt. gain mg/cm² | Fe/Si AES |
|---|---|---|---|---|---|---|---|
| 1 | 200 | 500 | 2.5 | 600 | overlay | <.02 | >19 |
| 2 | 150 | 500 | 3.3 | 600 | diffusion | 0.03 | 1.88 |
| 3 | 100 | 500 | 5.0 | 600 | diffusion | 0.05 | 1.24 |
| 4 | 50 | 500 | 10.0 | 600 | diffusion | 0.15 | 1.24 |
| 5 | 20 | 500 | 25.0 | 600 | diffusion | 0.20 | 0.81 |
| 6 | <10 | 500 | >50 | 600 | diffusion | O.43 | 0.46 |

Figure 2A:
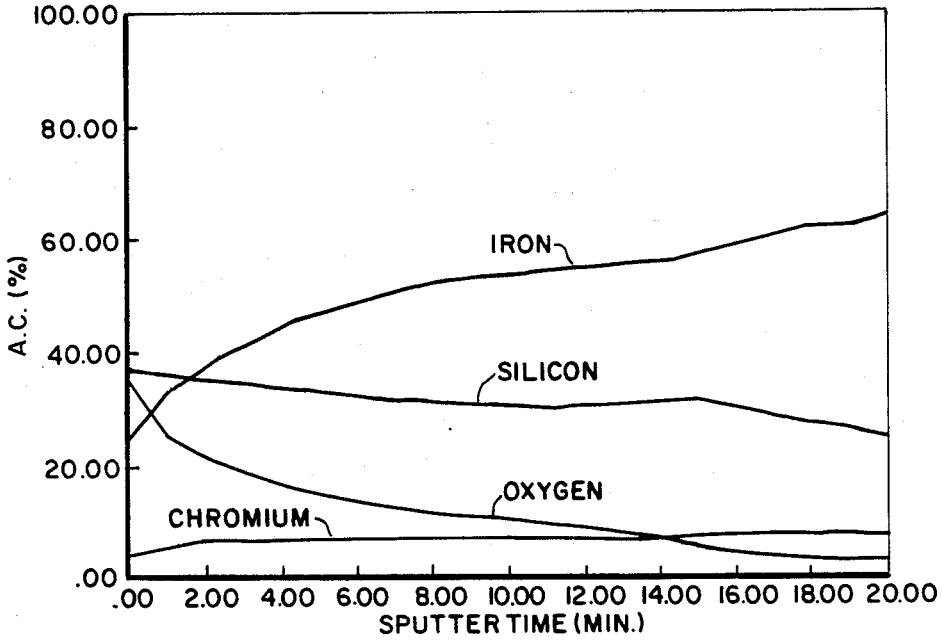
FIG. 2*a* is a plot similar to FIG. 1*a* of a sample treated according to the present invention wherein the water vapor was maintained at 150 ppm during the silicon deposition step at 600° C.
Figure 2B:
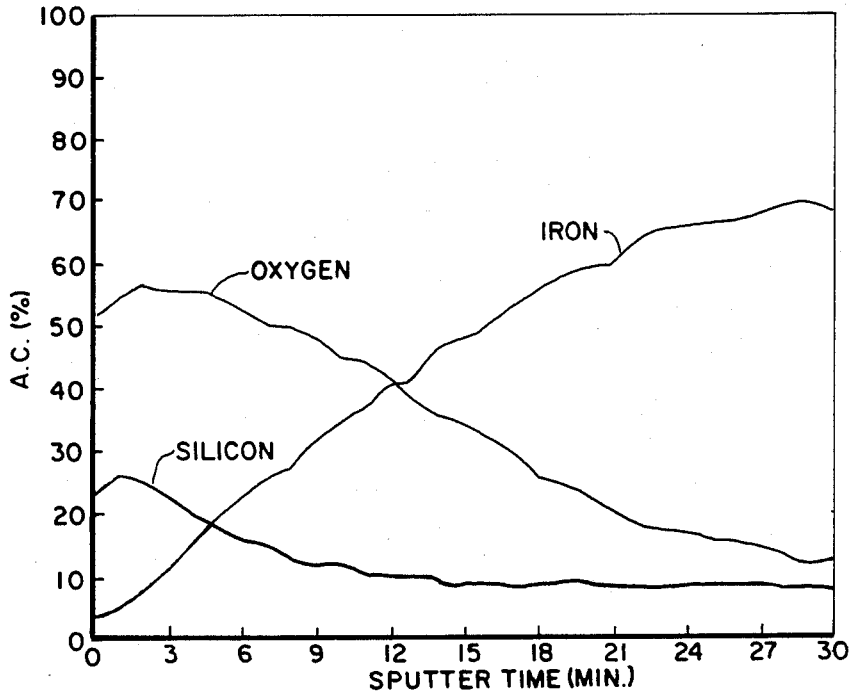
FIG. 2*b* is a plot similar to FIG. 2*a* wherein the water vapor content was maintained at 200 ppm during the silicon deposition step at 600° C.

Increasing the $H_2O$ level decreases the extent of siliconizing as evidenced by both the gravimetric uptake (weight gain, milligrams/sq. centimeter) and by the Fe/Si ratio determined by AES at the point in the depth profile at which the oxygen content was insignificant. $H_2O$ levels of 150 ppm and lower result in diffusion coatings according to the present invention. $H_2O$ levels of 200 ppm and higher will result in overlay coatings. This is demonstrated by AES depth profiles shown in FIGS. 2*a* and 2*b*. The sample surface of FIG. 2*a* was sputtered at a rate of 15 Å/min for fourteen minutes and then at a rate of 150 Å/min for six minutes. The sample surface of FIG. 2*b* was sputtered at a rate of 10 Å/min for thirty minutes.

Figure 3:
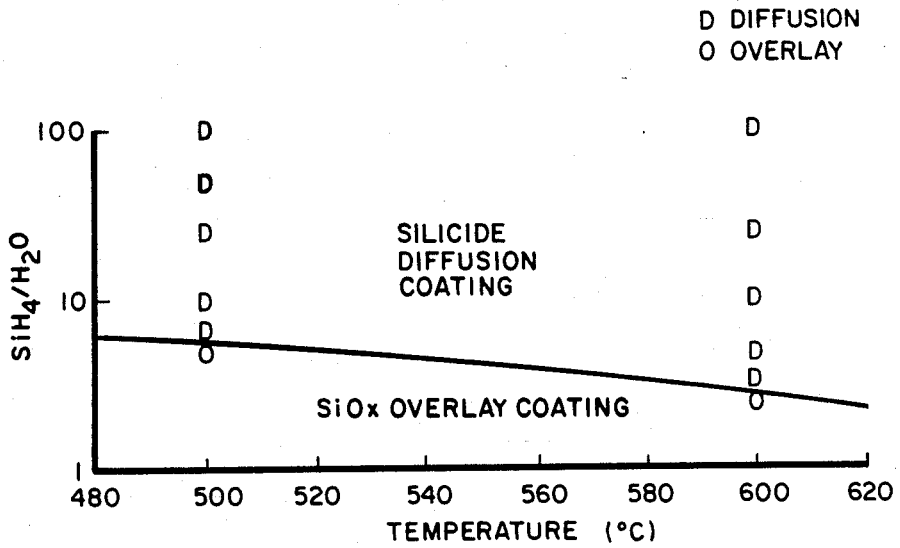
FIG. 3 is a plot of silane to water vapor ratio versus temperature showing treatments wherein either silicon diffusion coatings according to the present invention or silicon overlay coatings can be produced.

The results at 500° and 600° C. have been combined in FIG. 3 in a plot which illustrates the relationship between treatment temperature and the ratio of silane to water vapor in the atmosphere to effect either diffusion coatings according to the present invention or overlay coatings.

Example 5 was run to determine results for samples treated according to the prior art process set out in British Patent No. 1,530,337 and British Patent Application No. 2,107,360A.

EXAMPLE 5

A sample of 1"×¼"×1/16" alloy A182F9 (9% Cr/1% Mo/Fe) obtained from Metal Samples Co. was suspended using a quartz wire from a microbalance inside a quartz tube positioned in a tube furnace. The sample was treated in flowing dry $H_2$ (D.P.$<-60°$ C.; $H_2O/H_2<1\times10^{-5}$) at 800° C. for 30 min. to remove C, S, and O contaminants, then cooled to 500° C. The sample was treated according to the prior art teaching at 500° C. in 2% $H_2$/He with a water vapor content less than 100 ppm (90 ppm; $H_2O/H_2=4.5\times10^{-3}$) (for 24 hr). The sample was then treated in 500 ppm $SiH_4$/2% $H_2$/(He+Ar) with a water vapor content less than 100 ppm (90 ppm; $H_2O/H_2=4.5\times10^{-3}$) at 500° C. for 24 hr. The sample was cooled rapidly in the 90 ppm $H_2O$/2% $H_2$/(He+Ar) flow.

Figure 4:
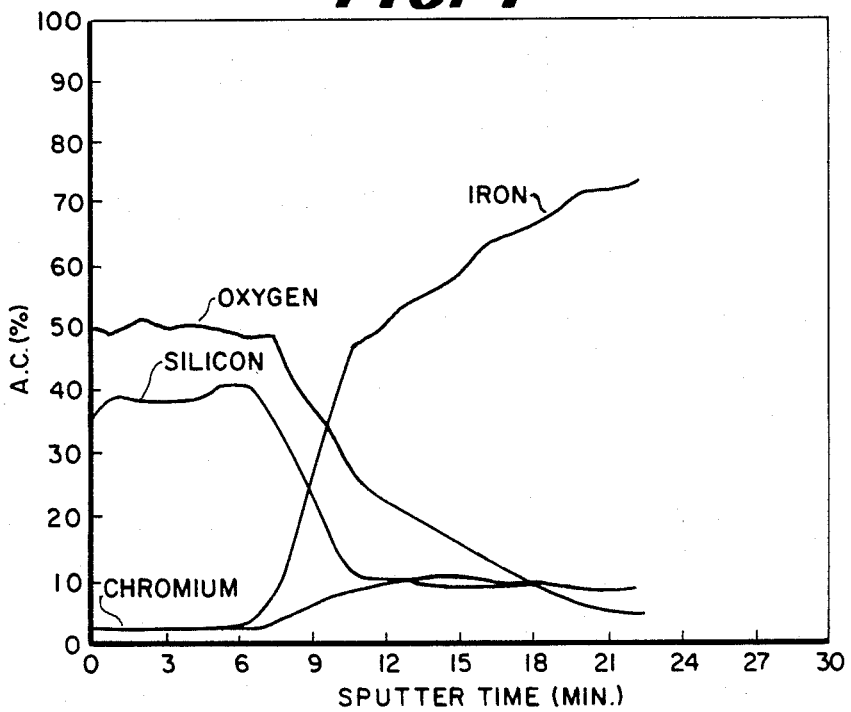
FIG. 4 is a plot of per cent composition of critical elements, determined by AES, versus sputtering time for a sample treated according to the prior art using the same alloy sample as in FIG. 1*a* and FIG. 1*b*.

The AES depth profile shown in FIG. 4 illustrates that the surface is covered with an overlay coating containing silicon oxides of about 0.13 microns thick. The sample surface was sputtered at a rate of 140 Å/min for twenty two minutes. From the results set out there was no evidence of diffusion of silicon into the surface of the base metal.

There is an oxide region below the Si-containing overlay coating. This oxide is about 500 Å thick and was probably formed during the pretreatment in 2% $H_2$/He with 90 ppm $H_2O$. The oxide is enriched in Cr relative to the concentration of Cr in the bulk. This Cr-rich oxide may be preventing diffusion of Si into the bulk.

Comparison of Example 5 to Example 4 clearly demonstrates the difference between the method of the present invention and that of the prior art for treatment of metals and alloys with $SiH_4$.

The treatment according to the present invention under reducing conditions results in a Si diffusion coating. The treatment according to the prior art results in a Si-containing overlay coating of silicon oxides. The rates of deposition are also significantly enhanced by the method of the present invention. In example 4 a 1.7 micron (μm) silicon coating was obtained (e.g. run 6) in 2.5 hours while in example 5 a 0.13 μm coating is obtained in 24 hours.

Thus considering examples 4 and 5 together, the results demonstrate the improvement of the present invention over what is believed to be the closest prior art. The two methods, although they involve similar treatments with mixtures of the same gases, yield entirely different and unexpected results. The characteristic of the method set forth in Example 5 of the prior art yields a highly oxygenated surface layer and an abrupt discontinuity between the surface layer and the substrate. This results in what is known as an overlay coating. The process according to the invention as illustrated by Example 4, on the other hand, provides a coating which varies continuously from a superficial oxide coating to a large diffused silicon layer containing both silicon and iron with a gradual transition from the high silicon surface down to the base metal. The coating produced by the process of the invention is a diffusion coating. A coating of this type will be less subject to thermal or mechanical shock than the coatings of the prior art. It will also be self-healing by providing a reservoir of silicon in the base material. A further advantage of a process according to the present invention is a relatively greater speed which the coating can be generated. With a coating according to the present invention a matter of hours is required whereas according to the prior art process several days are required to obtain a coating of the same thickness.

Example 6 demonstrates utility of a type 310 stainless steel with a selectively oxidized nickel silicide diffusion coating for inhibiting coke formation when exposed to a simulated ethane cracking environment.

EXAMPLE 6

A sample of AISI type 310 stainless steel with approximate dimensions of 0.3×0.4×0.004" was prepared, mounted, and treated as in Example 1.

The sample was heated in a 0.1% $SiH_4$ in $H_2$ mixture (by volume) at 700° C. for 15 min. at a total flow=1320 scc/min.

The sample was removed from the surface analysis system and suspended with a quartz wire from a microbalance inside a quartz tube positioned in a tube furnace. The sample was treated in dry $H_2$ at 1040° C. to reduce the surface. It was then treated in $H_2/N_2/H_2O$ at a $P_{H2O}/P_{H2}=2.1\times10^{-4}$ to form a $SiO_2$ surface film.

The sample was cooled to 850° C. and exposed to a simulated ethane cracking environment (Ethane: 120 cc/min; Nitrogen: 500 cc/min; Ethane $H_2O$ mole ratio=4) for 1 hr periods. Decoking was accomplished by turning off the ethane flow for 30 min. No detectable weight gain was observed (<0.05 μg/sec) for two coking cycles as compared to weight gains of 0.2–2.6 μg/sec in the first cycle for control runs.

Example 7 demonstrates that silicon diffusion coatings can be effectively produced on pure metals (e.g. iron) using the process of the present invention.

EXAMPLE 7

Samples of 1"×0.5"×0.002" foils of pure Fe from Alfa (99.99% pure), cleaned in an acetone sonic bath and hung from a micro balance. Samples were then treated in the following manner:

(1) Treat sample at 800° C. for 1 hr. in flowing dry $H_2$ (D.P.=−54.7° C.).
(2) Lower temperature to 500° C. and select desired dew point in the $H_2$ flow.
(3) Admit 0.5% $SiH_4/H_2$ at a flow rate that yielded a final mixture of 800 ppm in $H_2$ for 15–30 min (total flow=480 cc/min).
(4) Turn off $SiH_4/H_2$ mixture, purge with dry He and cool down to room temperature.
(5) Analyze surface composition using AES depth profiling to determine diffusion vs. overlay coating.

Using AES depth profiling, a diffusion coating is observed in a Fe sample that was siliconized at 500° C. with a mixture of 800 ppm $SiH_4$ and 25 ppm $H_2O$ in $H_2$ ($SiH_4/H_2O=32$ ).

The results set forth in Example 8 demonstrate that silicon diffusion coatings can be produced for high temperature oxidation protection of various metal parts.

EXAMPLE 8

A sample of 1.0×0.5×0.002" carbon steel 1010 (99.2% Fe) obtained from Teledyne Rodney Metals was suspended using a quartz wire from a microbalance inside a quartz tube positioned in a tube furnace. The sample was treated in flowing dry $H_2$ (D.P.=−60° C.) at 800° C. for 1 hour at a flow of 400 cc/min and then cooled to 600° C. The sample was then treated in a mixture of 0.12% $SiH_4$ in $H_2$ (by volume) until it gained 2 mg in weight and then cooled rapidly in flowing $H_2$. It was estimated that a $Fe_3Si$ diffusion coating of about 3 μm was formed with this treatment.

After this siliconizing step, the sample was kept under flowing He and heated up to 800° C. The gas flow was then switched to pure $O_2$ and the weight increase due to oxidation was monitored for 1 hour. The sample yielded a linear oxidation rate of 0.23 $\mu g\times cm^{-2}\times min^{-1}$ and the adhesion of the surface film was good. An untreated sample of carbon steel 1010 yielded an oxidation rate of $2.7\times10^4\ \mu g\times cm^{-2}\times min^{-1}$ under identical conditions. Therefore, there was a reduction of $1.2\times10^5$ times in the oxidation rate for the siliconized sample.

From the foregoing examples, it is apparent that processes according to the present invention can be utilized to provide silicon diffusion in a metal or other substrate. The present invention is distinguished over the prior art by the fact that the present invention teaches the use of a pretreatment to remove any diffusion barriers such as oxide films or carbon impurities on the surface of the substrate which might inhibit the deposition of the silicon on the surface and the diffusion of the silicon into the surface of the substrate. As amply demonstrated above the process is effected by carefully controlling the water vapor content of the reducing atmosphere during the pretreatment step and the water vapor content of the atmosphere and the ratio of silane to water vapor during the treatment step.

Thus according to the present invention many substrates can be given a diffusion coating of silicon which coating can subsequently be oxidized to provide a silicon dioxide coating which will resist attack under various conditions of use.

Having thus described our invention what is desired to be secured by Letters Patent of the United States as set forth in the appended claims:

1. A method of forming a silicon diffusion coating on the surface of a metal said metal subject formation of a surface oxide that can be reduced by a furnace treatment under controlled atmosphere, the steps comprising:

(a) pretreating said metal by heating said metal under conditions of, temperature less than 1200° C. under a controlled atmosphere reducing to elemental constituents of said metal to reduce or prevent formation of a barrier coating on exposed surfaces of said metal; and (b) treating said metal under conditions where said metal article can be maintained at a temperature of less than 1000° C. under a controlled atmosphere consisting of silane at least 1 part per million by volume, balance hydrogen or hydrogen and inert gas mixture wherein said atmosphere contains silane to oxygen in a molar ratio greater than 2.5 and oxygen to hydrogen in a molar ratio less than $2\times10^{-4}$ whereby silicon is diffused into the surface of said metal article.

2. A process according to claim 1 wherein following said treating steps said metal is exposed to an atmosphere containing an oxygen donor whereby at least a portion of said diffused silicon layer is preferentially oxidized to form a protective coating of silicon oxides.

3. A process according to claim 2 wherein said oxygen donor is selected from the group consisting of water vapor and hydrogen; hydrogen, nitrogen and water vapor; and hydrogen and nitrous oxide.

4. A process according to claim 2 wherein said atmosphere containing an oxygen donor is reducing to components of the metal at the treating temperature.

5. A process according to claim 1 wherein said pretreatment step is conducted under an atmosphere selected from the group consisting of hydrogen and hydrogen and inert gas where the molar ratio of oxygen to hydrogen is less than $2\times10^{-4}$.

6. A process according to claim 1 wherein the treating step is carried out in an atmosphere consisting of 1 ppm to 5 per cent by volume silane, balance hydrogen or hydrogen inert gas mixture.

7. A process according to claim 1 wherein the treatment step is carried out under an atmosphere containing 500 ppm to 5 per cent by volume silane balance hydrogen.

8. A process according to claim 1 wherein said process is carried out in a single furnace in stepwise fashion under an atmosphere consisting essentially of hydrogen controlled as to, water vapor content in said pretreating step and hydrogen diluted with silane and controlled as to water vapor in said treating step.

9. A process according to claim 1 where said metal is maintained at a temperature of between 500° C. and 1000° C. in both said pretreating and treating steps.

10. A process according to claim 1 wherein said pretreating and said treating atmospheres are hydrogen based wherein said hydrogen has a dew point of −60° C. or below.

11. A process according to claim 1 wherein said metal is a ferrous metal.

12. A process according to claim 1 wherein said metal is used in a high temperature oxidizing environment.

13. A process according to claim 2 wherein said metal is a ferrous metal.

14. A process according to claim 2 wherein said metal is used in a high temperature oxidizing environment.

15. A method of protecting a metal said metal subject to formation of a surface oxide that can be reduced by a furnace treatment under controlled atmosphere by forming a silicon diffusion coating on the exposed surface of said metal the steps comprising (a) pretreating said metal by heating in a furnace maintained at a temperature of at least 400° C. under a furnace atmosphere reducing to elemental constituents of said metal to reduced or prevent formation of a barrier film on exposed surfaces of said metal;

(b) treating said metal in a furnace maintained at a temperature of at least 400° C. under a furnace atmosphere consisting of silane at least 500 parts per million by volume balance hydrogen or hydrogen and inert gas mixture wherein said atmosphere contains silane to oxygen in a molar ratio greater than 2.5 and oxygen to hydrogen in a molar ratio less than $2\times10^{-4}$ whereby silicon is diffused into the surface of said metal.

16. A process according to claim 15 wherein following said treatment under silane said article is exposed to an atmosphere containing an oxygen donor whereby at least a portion of said diffused silicon layer is preferentially oxidized to form a protective coating of silicon oxides.

17. A process according to claim 16 wherein said oxygen donor is selected from the group consiting of water vapor and hydrogen; hydrogen, nitrogen, and water vapor; and hydrogen and nitrous oxide.

18. A process according to claim 16 wherein said atmosphere containing an oxygen donor is reducing to components of the metal at treating temperature.

19. A process according to claim 15 wherein said pretreatment step is conducted under an atmosphere of hydrogen where the molar ratio of oxygen to hydrogen is less than $2\times10^{-4}$.

20. A process according to claim 15 wherein the treating step is carried out in an atmosphere consisting of 1 ppm to 5 per cent by volume silane, balance hydrogen or a hydrogen inert gas mixture.

21. A process according to claim 15 wherein the treatment step is carried out under an atmosphere containing 500 ppm to 5 per cent by volume silane balance hydrogen.

22. A process according to claim 15 wherein said process is carried out in a single furnace in stepwise fashion under an atmosphere consisting essentially of hydrogen controlled as to, water vapor content in said pretreating step and hydrogen diluted with silane and controlled as to water vapor in said treating step.

23. A process according to claim 15 where said furnace is maintained at a temperature of between 500° C. and 1000° C. in both said pretreating and treating steps.

24. A process according to claim 15 wherein said pretreating and said treating atmospheres are hydrogen based wherein said hydrogen has a dew point of −60° C. or below.

25. A process according to claim 15 wherein said metal is a ferrous metal.

26. A process according to claim 16 wherein said metal is a ferrous metal.

27. A method of protecting a metal article said metal article subject to formation of a surface oxide that can be reduced by a furnace treatment under controlled atmosphere comprising the steps of:

(a) pretreating said metal article by heating said metal under conditions of, temperature less than 1200° C. under a controlled atmosphere reducing to elemental constituents of said metal to reduce or prevent formation of a barrier film on exposed surfaces of said metal;

(b) treating said article to form a silicon diffusion coating on exposed surfaces of said article; and (c) exposing said article to an oxidation treatment under an atmosphere containing an oxygen donor whereby at least a portion of said diffused silicon layer is preferentially oxidized to form a protective coating of silicon oxides.

28. A process according to claim 27 wherein said pretreatment step is conducted under an atmosphere of hydrogen where the molar ratio of oxygen to hydrogen is less than $2\times10^{-4}$.

29. A process according to claim 27 wherein the silicon diffusion coating is formed by heating said metal article in an atmosphere selected from the group consisting of 1 ppm to 5 per cent by volume silane and 1 ppm to 5 per cent by volume volatile silicon compound, balance hydrogen or a hydrogen-inert gas mixture.

30. A process according to claim 27 wherein the silicon diffusion coating is formed by heating said metal article under an atmosphere containing 500 ppm to 5 per cent by volume silane balance hydrogen.

31. A process according to claim 27 wherein said oxygen donor is selected from the group consisting of water vapor and hydrogen; hydrogen, nitrogen and water vapor; and hydrogen and nitrous oxide.

32. A process according to claim 27 wherein said process is carried out in a single furnace in stepwise fashion under an atmosphere consisting essentially of hydrogen controlled as to, water vapor content in said pretreating step and hydrogen diluted with silane and controlled as to water vapor in said treating step.

33. A process according to claim 27 where said metal is heated to a temperature of between 500° C. and 1000° C. in both said pretreating and treating steps.

34. A process according to claim 27 wherein said pretreating and said treating atmospheres are hydrogen based wherein said hydrogen has a dew point of −60° C. or below.

35. A process according to claim 27 wherein said metal is a shaped article used in an ethane cracking environment.

36. A process according to claim 27 wherein said metal is a ferrous metal.

* * * * *